US012578127B2

(12) United States Patent
Crane

(10) Patent No.: US 12,578,127 B2
(45) Date of Patent: Mar. 17, 2026

(54) COOLING SYSTEMS

(71) Applicant: GE ENERGY POWER CONVERSION TECHNOLOGY LIMITED, Warwicksire (GB)

(72) Inventor: Allan David Crane, Blaenau Ffestiniog (GB)

(73) Assignee: GE ENERGY POWER CONVERSION TECHNOLOGY LIMITED, Warwicksire (GB)

( * ) Notice: Subject to any disclaimer, the term of this patent is extended or adjusted under 35 U.S.C. 154(b) by 0 days.

(21) Appl. No.: 18/568,543

(22) PCT Filed: Jul. 30, 2021

(86) PCT No.: PCT/GB2021/051972
§ 371 (c)(1),
(2) Date: Dec. 8, 2023

(87) PCT Pub. No.: WO2023/007108
PCT Pub. Date: Feb. 2, 2023

(65) Prior Publication Data
US 2025/0085034 A1 Mar. 13, 2025

(51) Int. Cl.
*F25B 25/00* (2006.01)
*F25B 23/00* (2006.01)
*F25B 41/20* (2021.01)

(52) U.S. Cl.
CPC ..... *F25B 25/005* (2013.01); *F25B 23/006* (2013.01); *F25B 41/20* (2021.01); *F25B 2400/23* (2013.01)

(58) Field of Classification Search
CPC ..... F25B 25/005; F25B 41/20; F25B 23/006; F25B 6/02; F25B 2400/23
See application file for complete search history.

(56) References Cited

U.S. PATENT DOCUMENTS

2009/0077981 A1 3/2009 Wyatt et al.
2011/0157828 A1 6/2011 Weber et al.
(Continued)

FOREIGN PATENT DOCUMENTS

CN 1416201 A 5/2003
EP 2161820 B1 2/2019
(Continued)

OTHER PUBLICATIONS

International Search Report and Written Opinion for International Application No. PCT/GB2021/051972 dated May 3, 2022, 10 pages.

*Primary Examiner* — Miguel A Diaz
(74) *Attorney, Agent, or Firm* — Wood IP, LLC; Theodore A. Wood

(57) ABSTRACT

A cooling system for cooling an item of industrial equipment is described. The cooling system includes a primary circuit around which a cooling fluid is circulated, and which includes a two-phase heat exchanger. A secondary circuit is fluidly connected to the primary circuit in parallel with the heat exchanger. The secondary circuit includes a condenser, a pump, a separator and reservoir tank and a restrictor. The boiling point of the cooling fluid at the inlet of the heat exchanger is reduced by the action of the secondary circuit, thereby improving the cooling performance of the cooling system.

15 Claims, 4 Drawing Sheets

(56) References Cited

U.S. PATENT DOCUMENTS

| | | | | |
|---|---|---|---|---|
| 2019/0316817 | A1 | 10/2019 | Donovan et al. | |
| 2020/0113083 | A1 | 4/2020 | Schon et al. | |
| 2023/0228462 | A1* | 7/2023 | Fujii ..... | F25B 25/005 62/189 |

FOREIGN PATENT DOCUMENTS

| | | | |
|---|---|---|---|
| EP | 2704297 | B1 | 2/2020 |
| GB | 190614460 | A | 6/1907 |
| GB | 1201297 | A | 8/1970 |
| GB | 1488563 | A | 10/1977 |
| KR | 20120058481 | A | 6/2012 |
| MX | 2016001752 | A | 7/2017 |
| WO | 2012148149 | A2 | 11/2012 |

* cited by examiner

COOLING SYSTEMS

TECHNICAL FIELD

The present invention relates to cooling systems, and in particular to cooling systems for cooling an item of industrial equipment.

As used herein, the term "industrial equipment" should be taken to include any electrical, mechanical or electro-mechanical equipment that generates heat during use and that can be cooled by the cooling systems of the present invention. Non-limiting examples of industrial equipment may include electrical machines (e.g., motors and generators), transformers, power supplies, power converters, fabrication, production or manufacturing equipment, machinery etc.

BACKGROUND ART

Cooling systems for cooling items of industrial equipment are known. Often such cooling systems use halogenated fluids as a cooling fluid because they have good thermal performance and dielectric properties. But they are also expensive and have high toxicity.

Accordingly, there is a desire for an improved cooling system, and in particular for a cooling system that uses a cooling fluid with good thermal performance and dielectric properties, but which is relatively low-cost, has low toxicity and good anti-freeze properties.

SUMMARY OF THE INVENTION

The present invention provides a cooling system comprising:

- a primary circuit around which a cooling fluid is circulated, the primary circuit comprising:
  - a primary condenser having an inlet and an outlet, and
  - a two-phase heat exchanger having an inlet and an outlet,
  - wherein the outlet of the primary condenser is in fluid communication with the inlet of the heat exchanger and the outlet of the heat exchanger is in fluid communication with the inlet of the primary condenser; and
- a secondary circuit, fluidly connected to the primary circuit in parallel with the heat exchanger and comprising:
  - a secondary condenser having an inlet and an outlet,
  - a secondary pump for moving a proportion of the cooling fluid at the outlet of the heat exchanger through the secondary circuit and having an inlet and an outlet,
  - a separator, e.g., a separator and reservoir tank, for separating the cooling fluid into liquid and gaseous components having an inlet and an outlet for the liquid component, and
  - a restrictor having an inlet and an outlet,
  - wherein the outlet of the heat exchanger is in fluid communication with the inlet of the secondary condenser, the outlet of the secondary condenser is in fluid communication with the inlet of the pump, the outlet of the pump is in fluid communication with the inlet of the separator, the outlet of the separator is in fluid communication with the inlet of the restrictor, and the outlet of the restrictor is in fluid communication with the inlet of the heat exchanger.

The cooling system is preferably a closed-loop cooling system. The components of the cooling system can be fluidly connected by suitable tubing or pipework. In particular, where respective inlets and outlets are described herein as being fluidly connected, it will be understood that this does not mean that they must be directly connected, but that they will normally be indirectly connected by means of suitable tubing or pipework.

Any suitable cooling fluid can be used, but a preferred cooling fluid is a mixture of water and an anti-freeze compound. The water is preferably deionised water. The anti-freeze compound preferably has low toxicity and can be a glycol (e.g., propylene glycol) or a combination of glycols according to toxicity requirements. Suitable glycols include mono-, di-, and tri-variants of propylene glycol and ethylene glycol, for example. Such a preferred cooling fluid has particular advantages when used in the cooling system because it:

- is relatively low-cost,
- has low toxicity and environmental impact-particularly when compared with other known cooling fluids such as low cost halogenated fluids, and
- has good anti-freeze and dielectric properties, thereby allowing the cooling system to be used in low-temperature environments where a dielectric withstand is required.

The preferred cooling fluid can comprise between about 0% and about 50% of the anti-freeze compound with the balance being water (e.g., about 0-50% glycol(s)). It will be understood that increasing the percentage of anti-freeze compound will typically increase the boiling point of the mixture at ambient atmospheric pressure and also its viscosity, and that consequently these potentially negative factors must be balanced against an improved protection against freezing.

The cooling fluid can be circulated around the primary circuit by any suitable means, e.g., using a primary pump or thermosyphon circulation. As used herein, the term "thermosyphon circulation" is defined as a gravitationally circulated mechanism wherein the primary condenser is at a higher level than the heat exchanger(s) and wherein the density of the cooling fluid in the primary condenser is greater than that within the heat exchanger(s). It is also preferred that the condenser is at a higher level than the heat exchanger(s) in pump-circulated systems. The primary circuit can include a primary pump having an inlet and an outlet. The primary pump can have an adjustable output flow rate. The outlet of the primary condenser can be in fluid communication with the inlet of the primary pump and the outlet of the primary pump can be in fluid communication with the inlet of the heat exchanger. In this case, the secondary circuit is preferably fluidly connected to the primary circuit in parallel with both the primary pump and the heat exchanger—i.e., where the outlet of the restrictor is in fluid communication with the inlet of the primary pump.

As used herein a "two-phase heat exchanger" refers to a heat exchanger where the cooling fluid that is supplied to the inlet of the heat exchanger undergoes a phase change as a result of heat transfer and where the cooling fluid at the outlet is a two-phase cooling fluid—i.e., it comprises components in both the liquid and gaseous phase (sometimes referred to below as a "liquid component" and a "gaseous component" of the cooling fluid). Such a heat exchanger can be contrasted with a "single-phase heat exchanger, for example, where the cooling fluid at both the inlet and outlet is in the liquid phase. The heat exchanger can have any suitable construction and in one arrangement, for example, can comprise two or more individual heat exchange units fluidly connected in series or parallel or series-parallel between the inlet and the outlet. In the case where the heat exchange units are arranged in parallel, the inlet and the outlet can be defined by manifolds. As used herein "two-phase heat transfer" refers to heat transfer—e.g., between the cooling fluid and an item of industrial equipment—that results in the cooling fluid undergoing a phase change.

The heat exchanger (or each heat exchange unit) can also be referred to as an evaporator or evaporative surface. An evaporator is typically a solid body with one or more fluid passages through which the cooling fluid is circulated. The item of industrial equipment to be cooled can be mounted on, or is in heat-transfer contact with, one or more solid bodies. Heat generated by the item of industrial equipment is transferred into the one or more solid bodies. The layer of cooling fluid that is in contact with the internal wall of each fluid passage (the so-called "boundary layer") boils or evaporates. The dryness fraction of the cooling fluid should remain below 1.0—and more preferably below about 0.9—to ensure that sufficient liquid coolant is in contact with the internal wall. Evaporative surfaces are surfaces of components that require cooling and which are immersed in the cooling fluid. The fluid that is in contact with the external surface of the component to be cooled boils or evaporates. The dryness fraction of the cooling fluid should remain below 1.0—and more preferably below about 0.9—to ensure that sufficient liquid coolant is in contact with the component surfaces.

Heat exchanger surfaces that are in contact with the cooling fluid can have surface profiles that increase the surface area of the heat exchanger surfaces relative to heat exchanger volume, in order to reduce the heat flux density and minimise the likelihood of an excessive dryness fraction.

The heat exchanger can be in heat transfer with one or more items of industrial equipment for cooling the same. In one arrangement, the heat exchanger can be provided as an integral part of the one or more items of industrial equipment, e.g., as a cooling passageway or as an evaporative surface, or can be positioned on any interior or exterior surface. In general, the heat exchanger can be adapted to cool any particular part or component of the one or more items of industrial equipment such as the rotor or stator of an electrical machine, the laminated core or winding of a transformer, or a power electronics module, for example.

Heat is transferred from the one or more items of industrial equipment to the cooling fluid, thereby increasing the temperature of the cooling fluid within the heat exchanger to its boiling point. As explained above, the cooling fluid, which is in the liquid phase at the inlet of the heat exchanger, undergoes a phase change within the heat exchanger and at the outlet the cooling fluid comprises components in both the liquid and gaseous phase. The gaseous component of the cooling fluid may be in the form of bubbles that are entrained within the liquid component.

The primary condenser can have any suitable construction and can use heat transfer (e.g., with a separate cooling circuit) to reduce the temperature of the cooling fluid flowing through the primary condenser, thereby condensing the component of the cooling fluid that is in the gaseous phase back to the liquid phase. The cooling fluid at the outlet of the primary condenser is almost entirely in the liquid phase.

The secondary condenser can also have any suitable construction and can use heat transfer (e.g., with a separate cooling circuit) to reduce the temperature of the cooling fluid flowing through the secondary condenser, thereby condensing at least part of the gaseous component of the cooling fluid back to the liquid phase. The cooling fluid at the outlet of the secondary condenser can still comprise both liquid and gaseous components, however the proportion of the gaseous component of the cooling fluid at the outlet of the secondary condenser will preferably be less than the proportion of the gaseous component at the inlet to the secondary condenser. This allows the construction of the secondary pump to be simplified because it does not need to cope with a significant proportion of the cooling fluid at the inlet being in the gaseous phase. The separate cooling circuits that are used in the primary and secondary condensers can use water or other process fluid as a cooling fluid. The primary and secondary condensers can also transfer heat to ambient air or other process gas.

The primary and secondary condensers can have a plate or tube and shell construction when heat is being transferred to water or other process fluid in the separate cooling circuits. The primary and secondary condensers can have a finned tube construction when heat is being transferred to ambient air or other process gas.

The secondary pump can have any suitable construction. Operation of the secondary pump draws a proportion of the cooling fluid at the outlet of the heat exchanger through the secondary condenser and supplies cooling fluid (which can still have both liquid and gaseous components) to the inlet of the separator. The remainder of the cooling fluid that is not drawn through the secondary circuit will flow to the inlet of the primary condenser. The normal flow path of cooling fluid through the secondary circuit is from the outlet of the heat exchanger to the inlet of the heat exchanger through the secondary condenser, the secondary pump, the separator and the restrictor.

On start-up of the cooling system, the secondary pump can be used to start the circulation through the primary circuit, i.e., by drawing cooling fluid through the heat exchanger. This can be particularly useful if the primary circuit relies on thermosyphon circulation.

The secondary pump can have an adjustable output flow rate. In other words, the secondary pump can be controlled to adjust the rate at which the cooling fluid is supplied from the outlet to the separator.

A non-return valve can be provided between the outlet of the secondary condenser and the inlet of the secondary pump to prevent cooling fluid from flowing in the opposite direction to the normal flow direction through the secondary circuit, i.e., from the secondary pump to the secondary condenser.

The separator can have any suitable construction. In particular, the separator can use any convenient separation mechanism, for example gravitational and/or centrifugal mechanisms that exploit buoyancy of gasses in liquids. In one arrangement the separator can be a separator and reservoir tank that is designed to gravitationally separate any gaseous components that were not condensed in the secondary condenser and are still entrained in the liquid component of the cooling fluid. These gaseous components will include any remaining gaseous component of the cooling fluid, but may also include other pollutants or volatile gasses, e.g., from transfer hoses or other components of the cooling system. The gaseous components are passively or actively outgassed and collected in a volume at the head of the tank above the liquid component of the cooling fluid. The tank can include a second outlet that allows the gaseous components to be vented, optionally through a non-return valve and/or pressure-relief valve. A non-return valve can prevent a vacuum occurring and a pressure relief valve can prevent excessive tank pressure. The cooling system can also employ other ways of separating the gaseous components that were not condensed in the secondary condenser—e.g., a separator that uses centrifugal separation.

The tank functions as a reservoir for the liquid component of the cooling fluid and accommodates the combined effects of thermal expansion and evaporation of the cooling fluid, also thermal expansion of all components within the system. More particularly, the cooling fluid expands as it is heated until attaining the phase change pressure, thereafter further heating causes the phase change to occur and the volume of two-phase cooling fluid increases because the gaseous component occupies more volume than the liquid component. These increases in volume cause the cooling fluid to accumulate in the tank. The interconnecting tubing or pipework and cooled components may all have unique coefficients of thermal expansion, have unique thermal time constants, and have elasticity or compressibility, and these may contribute to accumulation in the tank. Accordingly, the tank must incorporate sufficient compressible volume to accommodate this accumulation whilst its contents operate at safe operating pressures. The compressible volume of the tank may be separated from the cooling fluid by a flexible diaphragm or similar device. The operation of the secondary pump causes the liquid component of the cooling fluid to be supplied from the outlet of the tank to the inlet of the restrictor for reducing the pressure of the liquid component of the cooling fluid to a negative pressure.

The restrictor can have any suitable construction, e.g., a restrictor with a preset valve or a fixed or adjustable orifice, that is designed to reduce the pressure of the cooling fluid flowing through it. The restrictor can be an industry-standard orifice plate with single or multiple cylindrical orifices. Each orifice can optionally have entry and/or outlet chamfer or radius profiles in order to reduce turbulence which is often associated with undesirable structural vibration. Venturi type orifices can be employed. Although restrictors with an adjustable orifice can be used, they are not normally preferred because they can be unreliable.

Using the restrictor to reduce the pressure of the cooling fluid has the desirable effect of reducing its boiling point.

The pressure of the cooling fluid at the inlet of the restrictor can be selected by adjusting the output flow rate of the secondary pump. The restrictor can be designed to provide the required negative pressure—see below—at a particular output flow rate of the secondary pump. The secondary pump can be controlled by a pressure control system comprising a controller which is responsive to the output of a pressure sensor.

One or both of the secondary pump and the restrictor may be adjusted or controlled to select the suitable pressure at the outlet of the restrictor.

The cooling fluid at the outlet of the restrictor, and consequently, at the inlet of the heat exchanger that is in fluid communication with the outlet, will preferably have a suitable negative pressure—i.e., a pressure that is less than the ambient atmospheric pressure (less than about 100 kPa). For example, the pressure at the outlet of the restrictor can be in the range of about 10% to about 60% of the ambient atmospheric pressure (e.g., about 10-60 kPa).

The pressure is typically selected based on a desired boiling point of the cooling fluid—which in the case of the preferred cooling fluid will depend on the percentage of the anti-freeze compound. Put another way, a desired boiling point can be determined for the particular cooling fluid—for example, a boiling point of about 60° C.—and the negative pressure required to obtain the desired boiling point for a particular cooling fluid can be selected.

Table 1 shows the pressure in kPa required to achieve different boiling points for a cooling fluid comprising water and optionally propylene glycol as an anti-freeze compound. The percentage of propylene glycol varies from 0% to 50%.

TABLE 1

| Boiling | Percentage of propylene glycol | | | | | |
|---|---|---|---|---|---|---|
| point (° C.) | 0% | 10% | 20% | 30% | 40% | 50% |
| 50 | 12.3 | 12.3 | 12.1 | 11.7 | 11.3 | 10.8 |
| 55 | 15.8 | 15.7 | 15.4 | 14.9 | 14.3 | 13.7 |
| 60 | 19.9 | 19.8 | 19.4 | 18.8 | 18.0 | 17.3 |
| 65 | 25.0 | 24.8 | 24.3 | 23.5 | 22.6 | 21.7 |
| 70 | 31.2 | 30.8 | 30.2 | 29.3 | 28.0 | 27.0 |
| 75 | 38.6 | 38.0 | 37.2 | 36.1 | 34.6 | 33.4 |
| 80 | 47.4 | 46.7 | 45.6 | 42.2 | 42.4 | 40.9 |
| 85 | 57.8 | 56.9 | 55.6 | 53.8 | 51.6 | 49.9 |
| 90 | 70.1 | 68.9 | 67.3 | 65.1 | 62.4 | 60.4 |
| 100 | 101.3 | 99.3 | 96.9 | 93.7 | 89.9 | 87.1 |

It can be seen from Table 1 that the pressure at the outlet of the restrictor may need to be in the range of about 10% to about 32% of the ambient atmospheric pressure (e.g., about 10-32 kPa) in order for the cooling fluid to have a boiling point in the range of about 50° C. to about 70° C., and in the range of about 17% to about 20% of the ambient atmospheric pressure (e.g., about 17-20 kPa) in order for the cooling fluid to have a boiling point of about 60° C., where the percentage of propylene glycol in the cooling fluid varies between 0% and about 50%.

The reduction in the boiling point of the cooling fluid that flows through the heat exchanger provides a significant improvement in the cooling provided by the heat exchanger, when compared with an equivalent cooling system using the same cooling fluid but without any reduction in the boiling point of the cooling fluid, e.g., where the secondary circuit is omitted.

The secondary circuit can further comprise a deioniser, e.g., a resin bed deioniser, which is designed to remove substantially all ions from the cooling fluid, and in particular from the water in the case of the preferred cooling fluid. Removing the ions from the water is important for maintaining the dielectric properties of the cooling fluid.

A typical deioniser can remove both cations and anions from the cooling fluid using a chemical process that involves contacting the cooling fluid with a mixed bed of ion-exchange resins. The deioniser has an inlet and outlet. The deioniser can be positioned anywhere in the secondary circuit, but is preferably positioned between the separator and the restrictor. In particular, the outlet of the separator can be fluidly connected to the inlet of the deioniser and the outlet of the deioniser can be fluidly connected to the inlet of the restrictor. The secondary circuit can further comprise a bypass valve that selectively allows the cooling fluid to bypass the deioniser. The bypass valve can be controlled to open and close by a conductivity control system comprising a controller which is responsive to the output of a conductivity sensor in the primary circuit. The bypass valve can be controlled to preferably maintain the conductivity of the cooling fluid within the range of about 0.7 to about 1.2 μS/cm.

The cooling system can further comprise a filtration system for filtering the cooling fluid.

The present invention further provides a method of cooling an item of industrial equipment by circulating a cooling fluid around a primary circuit where the cooling fluid is condensed (e.g., using a primary condenser) and in two-phase heat transfer with the item of industrial equipment using a two-phase heat exchanger, and where a proportion of the cooling fluid at an outlet of the heat exchanger is moved through a secondary circuit, fluidly connected to the primary circuit in parallel with the heat exchanger, and where the cooling fluid in the secondary circuit is condensed (e.g., using a secondary condenser), separated into liquid and gaseous components (e.g., using a separator and reservoir tank or other suitable separator), and where the pressure of the liquid component of the cooling fluid is reduced to a negative pressure (e.g., using a restrictor) before being returned to the primary circuit so as to reduce the boiling point of the cooling fluid at an inlet of the heat exchanger.

The cooling fluid is preferably deionised (e.g., using a deioniser such as a resin bed deioniser in the secondary circuit).

DETAILED DESCRIPTION

Figure 1:
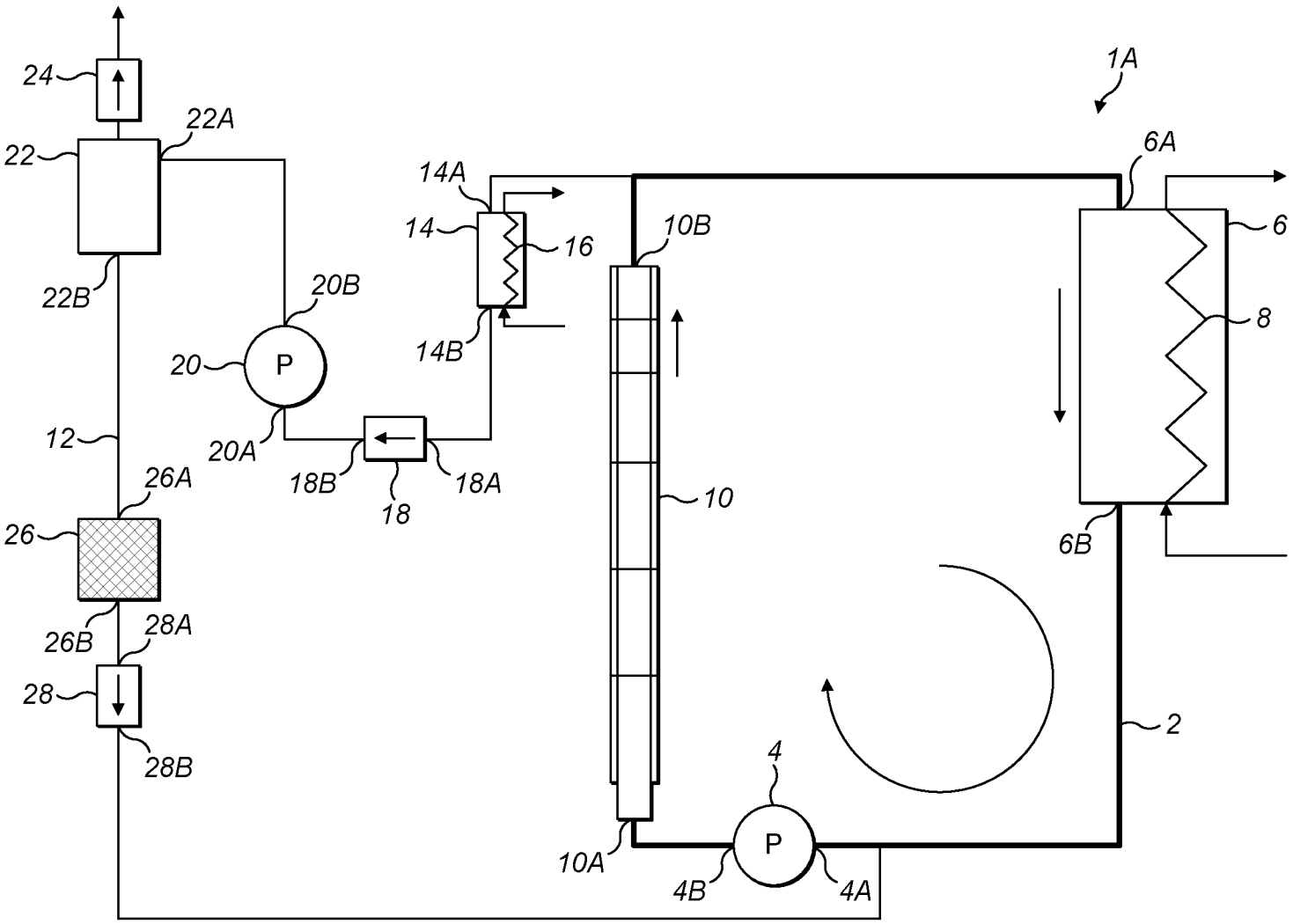
FIG. 1 is a schematic diagram of a first example of a cooling system according to the present invention.

A first example of a cooling system 1A is shown in FIG. 1. The cooling system 1A includes a primary circuit 2 around which a cooling fluid is circulated. The flow of cooling fluid is indicated by the arrows. The cooling fluid is a mixture of deionised water and propylene glycol, where the percentage of propylene glycol is 20%.

The cooling fluid is circulated around the primary circuit 2 by a primary pump 4 that has an inlet 4A and an outlet 4B. The primary pump 4 can have an adjustable output flow rate.

The primary circuit 2 includes a primary condenser 6 with an inlet 6A and an outlet 6B that is in fluid communication with the inlet 4A of the primary pump 4. The primary condenser 6 includes a separate water cooling circuit 8 for cooling the cooling fluid that is circulated through the primary condenser—see below.

The primary circuit 2 includes a two-phase heat exchanger 10 with an inlet 10A that is in fluid communication with the outlet 4B of the primary pump 4 and an outlet 10B that is in fluid communication with the inlet 6A of the primary condenser 6. The cooling fluid that is supplied to the inlet 10A of the heat exchanger 10 by the primary pump 4 undergoes a phase change as a result of heat transfer and the cooling fluid at the outlet 10B is a two-phase cooling fluid—i.e., it comprises components in both the liquid and gaseous phase. In this first example, the heat exchanger has a single heat exchange unit connected between the inlet 10A and the outlet 10B.

The differential pressure developed by the primary pump 4 is sufficient to cause circulation of the cooling fluid in the primary circuit 2 but is insufficient to substantially influence the boiling point of the cooling fluid. The differential pressure may typically be less than about 5 kPa, for example. The heat exchanger 10 and the primary condenser 6 are designed to respect the differential pressure limit, i.e., they must not be unduly restrictive to flow because this would tend to prevent boiling in the heat exchanger, particularly in the region of the heat exchanger inlet 10A.

Figure 2:
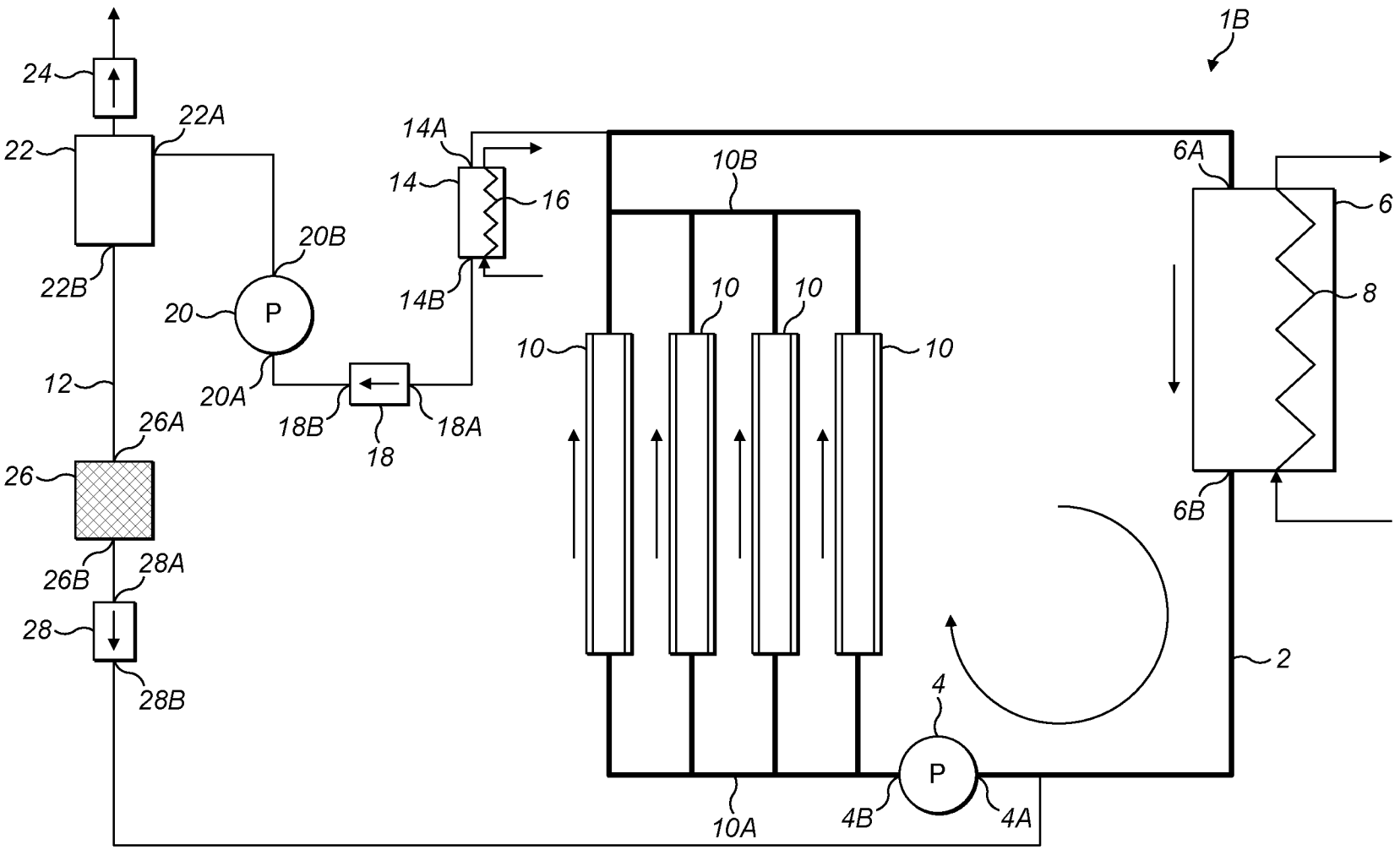
FIG. 2 is a schematic diagram of a second example of a cooling system according to the present invention.

In a second example of a cooling system 1B shown in FIG. 2, the heat exchanger has a plurality of individual heat exchange units connected in parallel between the inlet 10A and the outlet 10B. The inlet and outlet 10A, 10B are formed as manifolds. In another example which is not shown, the heat exchanger has a plurality of individual heat exchange units connected in series or series-parallel between the inlet and the outlet.

The heat exchanger 10 is in heat transfer with one or more items of industrial equipment (not shown) for cooling the same. In use, heat is transferred from the one or more items of industrial equipment (not shown) to the cooling fluid, thereby increasing the temperature of the cooling fluid within the heat exchanger 10 to its boiling point. As explained above, the cooling fluid, which is in the liquid phase at the inlet 10A of the heat exchanger 10, undergoes a phase change within the heat exchanger and at the outlet 10B the cooling fluid comprises components in both the liquid and gaseous phase. The gaseous component of the cooling fluid may be in the form of bubbles that are entrained within the liquid component, for example.

The primary condenser 6 uses heat transfer with a separate water cooling circuit 8 to reduce the temperature of the cooling fluid flowing through the primary condenser, thereby condensing the component of the cooling fluid that is in the gaseous phase back to the liquid phase. The cooling fluid at the outlet 6A of the primary condenser 6 is almost entirely in the liquid phase.

The cooling systems 1A and 1B include a secondary circuit 12 fluidly connected to the primary circuit 2 in parallel with the heat exchanger 10 as shown. In particular, the "upstream" end of the secondary circuit 12 is connected to the primary circuit 2 between the outlet 10B of the heat exchanger 10 and the inlet 6A of the condenser 6. The "downstream" end of the secondary circuit 12 is connected to the primary circuit 2 between the outlet 6B of the condenser 6 and the inlet 4A of the primary pump 4.

The secondary circuit 12 includes a secondary condenser 14 having an inlet 14A in fluid communication with the outlet 10B of the heat exchanger 10 and an outlet 14B. The secondary condenser 14 includes a separate water cooling circuit 16 for cooling the cooling fluid that passes through the secondary condenser. In particular, the secondary condenser 14 uses heat transfer with the separate water cooling circuit 16 to reduce the temperature of the cooling fluid flowing through the secondary condenser, thereby condensing at least part of the gaseous component of the cooling fluid back to the liquid phase. The cooling fluid at the outlet 14B of the secondary condenser 14 can still comprise both liquid and gaseous components, however the proportion of the gaseous component of the cooling fluid at the outlet 14B of the secondary condenser 14 will preferably be less than the proportion of the gaseous component at the inlet 14A of the secondary condenser.

The secondary circuit 12 includes a non-return valve 18 having an inlet 18A in fluid communication with the outlet 14B of the secondary condenser 14, and an outlet 18B.

A proportion of the cooling fluid at the outlet 10B of the heat exchanger 10 is moved through the secondary circuit 12 by a secondary pump (or "extraction pump") 20. The secondary pump 20 has an inlet 20A in fluid communication with the outlet 18B of the non-return valve 18, and an outlet 20B. Operation of the secondary pump 20 draws a proportion of the cooling fluid at the outlet 10B of the heat exchanger 10 through the secondary condenser 14 and supplies cooling fluid (which can still have both liquid and gaseous components) to an inlet 22A of a separator and reservoir tank 22 that is in fluid communication with the outlet 20B of the secondary pump 20. The remainder of the cooling fluid that is not drawn through the secondary circuit 12 will flow to the inlet 6A of the primary condenser 6. The secondary pump 20 has an adjustable output flow rate. In other words, the secondary pump 20 can be controlled to adjust the rate at which the cooling fluid is supplied from the outlet 20B to the tank 22 and consequently the rate at which the cooling fluid is supplied from an outlet 22B of the tank 22. The secondary pump 20 is responsive to a pressure control system (not shown) comprising a controller which is responsive to the output of a pressure sensor.

The non-return valve 18 prevents cooling fluid from flowing in the opposite direction to the normal flow direction through the secondary circuit, i.e., from the secondary pump 20 to the secondary condenser 14.

The tank 22 is designed to gravitationally separate any gaseous components that were not condensed in the secondary condenser 14 and are still entrained in the liquid component of the cooling fluid at its inlet 22A. These gaseous components will include any remaining gaseous component of the cooling fluid, but may also include other pollutants or volatile gasses, e.g., from transfer hoses or other components of the cooling system. The gaseous components are passively or actively outgassed and collected in a volume at the head of the tank 22 above the liquid component of the cooling fluid. In order to assist the gravitational separation of gases within the tank 22 it can be useful to have the outlet 22B lower than inlet 22A as shown. The tank 22 includes a second outlet that allows the gaseous components to be vented, optionally through a non-return valve or pressure-reducing valve 24. The tank 22 functions as a reservoir for the liquid component of the cooling fluid. The operation of the secondary pump 20 causes the liquid component of the cooling fluid to be supplied from the outlet 22B.

As described above, the tank 22 must incorporate sufficient compressible volume to accommodate this accumulation whilst its contents operate at safe operating pressures. The compressible volume of the tank may be separated from the cooling fluid by a flexible diaphragm or similar device (not shown).

A resin bed deioniser 26 has an inlet 26A in fluid communication with the outlet 22B of the tank 22, and an outlet 26B. The resin bed deioniser 26 can be designed to remove substantially all ions from the cooling fluid, and in particular from the water in the case of the preferred cooling fluid. In practice, it will be understood that the removal of ions from the cooling fluid only has to be sufficient to allow for the safe operation of the cooling system.

A restrictor 28 has an inlet 28A in fluid communication with the outlet 26B of the resin bed deioniser 26 and an outlet 28B in fluid communication with the inlet 4A of the primary pump 4 as shown. The restrictor 28 has a fixed orifice that is designed to provide the required negative pressure at a particular output flow rate of the secondary pump 20. The pressure is selected based on a desired boiling point of the cooling fluid. For example, if the desired boiling point is about 60° C. the restrictor 28 is defined to provide a pressure of about 20 kPa for the particular cooling fluid (i.e., 20% propylene glycol)—see Table 1—if the secondary pump 20 is operated at the particular output flow rate. In another example, the restrictor may be adjusted to select the pressure of the cooling fluid at the outlet, e.g., by using an adjustable valve or orifice. One or both of the secondary pump and the restrictor can then be adjusted or controlled to select the suitable pressure at the outlet of the restrictor, but it should be noted that there is no requirement for the restrictor to be servo-controlled. Reducing the boiling point of the cooling fluid that flows through the heat exchanger 10 to about 60° C. provides a significant improvement in cooling performance.

Figure 3:
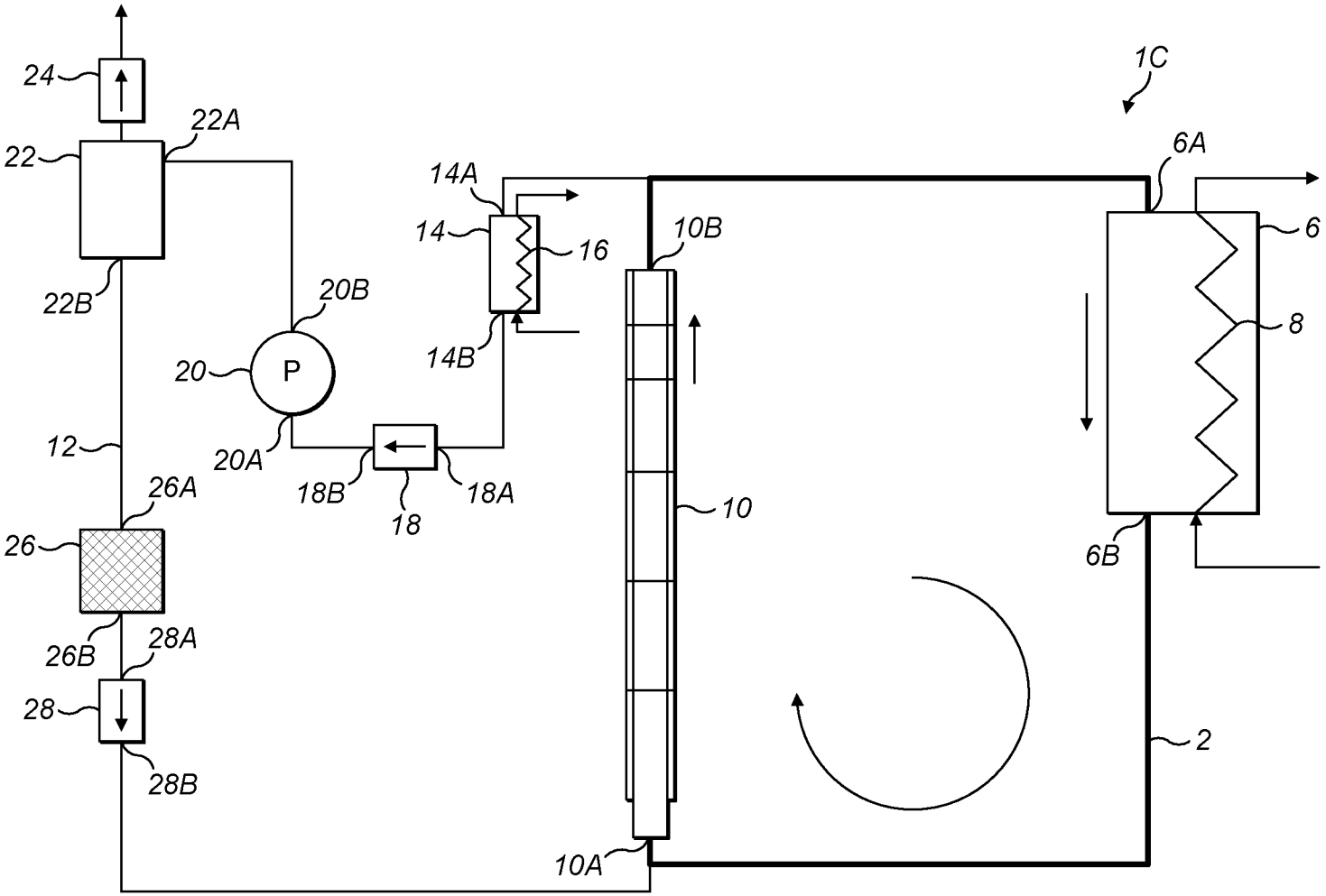
FIG. 3 is a schematic diagram of a third example of a cooling system according to the present invention.

A third example of a cooling system 1C is shown in FIG. 3. The cooling system 1C uses thermosyphon circulation to circulate the cooling fluid around the primary circuit 2 and there is no primary pump. On start-up of the cooling system 1C, the secondary pump 20 can be used to start the circulation through the primary circuit 2, i.e., by drawing cooling fluid through the heat exchanger 10. It is preferable that the point at which the fluid flow from the secondary circuit 12 merges with that of the primary circuit 2 near to the heat exchanger inlet 10A is configured so it does not cause reverse flow in the primary condenser 6. By aligning the secondary circuit fluid flow with the entry into heat exchanger inlet 10A or by using a venturi arrangement with three ports (not shown) the momentum from the primary circuit fluid flow may be used to generate a pressure reduction at the outlet 6B of the primary condenser 6.

For all of the cooling systems described above, the flow of cooling fluid in the secondary circuit 12 is defined by the requirement to regulate primary circuit pressure. The influence of the pressure drop across the resin bed deioniser 26 is typically far less significant than the pressure drop across the restrictor 28, but the restriction presented by the resin bed can be subject to wide tolerances and variation throughout its operating lifetime. The closed loop nature of the pressure control that is employed by the cooling system is such that the flow rate through the secondary circuit 12 can vary throughout its operating lifetime, and that accordingly, the effectiveness of the resin bed deioniser 26 can also vary throughout its operating lifetime.

The conductivity of the cooling fluid is preferably regulated because excessively high conductivity leads to undesirable electrolysis between live components within the cooling circuit, whereas excessively low conductivity results in the solvent action of the deionised water, upon metallic and non-metallic parts of the cooling circuit, being sufficient to dissolve these parts. The conductivity is therefore preferably maintained within the range about 0.7 to about 1.2 μS/cm.

Figure 4:
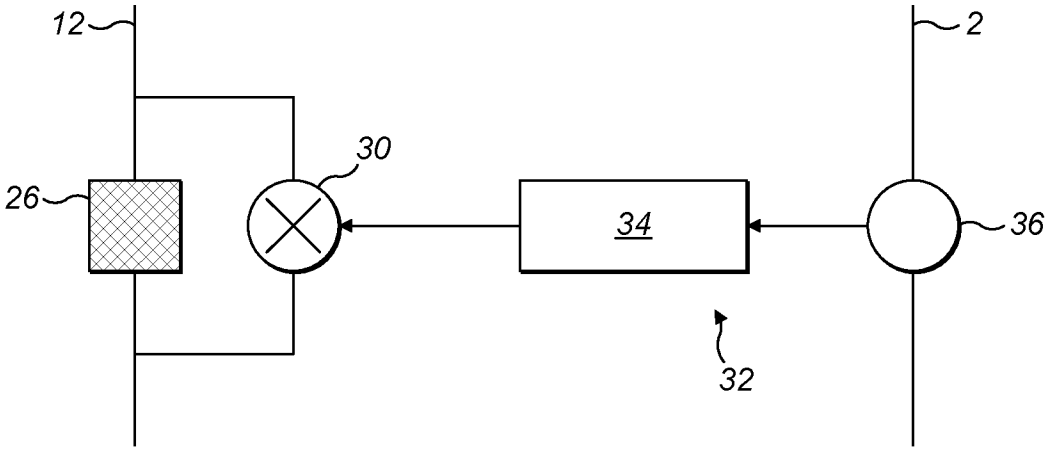
FIG. 4 is a schematic diagram of a bypass valve and conductivity control system.

As shown in FIG. 4, a two position (or switched) bypass valve 30 is responsive to a conductivity control system 32 comprising a controller 34 which is responsive to the output of a conductivity sensor 36 in the primary circuit 2. When the bypass valve 30 is open, cooling fluid in the secondary circuit 12 is allowed to flow through the bypass valve and around the resin bed deioniser 26. When the cooling system is operating, the conductivity of the cooling fluid slowly ramps up and down between defined limits when the bypass valve 30 is open and closed, respectively. It may take a few hours for the conductivity to transit between these defined limits. The momentary fluctuations in primary circuit pressure during changes in bypass valve state have minimal effect upon cooling performance.

The invention claimed is:

1. A cooling system comprising:

a primary circuit around which a cooling fluid is circulated, the primary circuit comprising:

a primary condenser having an inlet and an outlet, and a two-phase heat exchanger having an inlet and an outlet, wherein the outlet of the primary condenser is in fluid communication with the inlet of the two-phase heat exchanger and the outlet of the two-phase heat exchanger is in fluid communication with the inlet of the primary condenser; and a secondary circuit, fluidly connected to the primary circuit in parallel with the two-phase heat exchanger and comprising:

a secondary condenser having an inlet and an outlet, a secondary pump for moving a proportion of the cooling fluid at the outlet of the two-phase heat exchanger through the secondary circuit and having an inlet and an outlet, a separator for separating the cooling fluid into liquid and gaseous components having an inlet and an outlet for the liquid component, and a restrictor having an inlet and an outlet, wherein the outlet of the two-phase heat exchanger is in fluid communication with the inlet of the secondary condenser, the outlet of the secondary condenser is in fluid communication with the inlet of the secondary pump, the outlet of the secondary pump is in fluid communication with the inlet of the separator, the outlet of the separator is in fluid communication with the inlet of the restrictor, and the outlet of the restrictor is in fluid communication with the inlet of the two-phase heat exchanger.

2. The cooling system according to claim 1, wherein the cooling fluid is a mixture of water, optionally deionised water, and an anti-freeze compound.

3. The cooling system according to claim 2, wherein the anti-freeze compound is glycol.

4. The cooling system according to claim 1, wherein the primary circuit further comprises a primary pump having an inlet and an outlet, wherein the outlet of the primary condenser is in fluid communication with the inlet of the primary pump and the outlet of the primary pump is in fluid communication with the inlet of the two-phase heat exchanger.

5. The cooling system according to claim 4, wherein the secondary circuit is fluidly connected to the primary circuit in parallel with both the primary pump and the two-phase heat exchanger.

6. The cooling system according to claim 1, wherein the two-phase heat exchanger comprises two or more heat exchange units fluidly connected in series or parallel or series-parallel between the inlet and the outlet.

7. The cooling system according to claim 1, wherein the secondary pump has an adjustable output flow rate.

8. The cooling system according to claim 1, further comprising a non-return valve fluidly connected between the outlet of the secondary condenser and the inlet of the secondary pump.

9. The cooling system according to claim 1, wherein the separator is a separator and reservoir tank.

10. The cooling system according to claim 1, wherein the secondary circuit further comprises a deioniser, optionally a resin bed deioniser, having an inlet and an outlet, wherein the outlet of the separator is fluidly connected to the inlet of the deioniser and the outlet of the deioniser is fluidly connected to the inlet of the restrictor.

11. The cooling system according to claim 10, wherein the secondary circuit further comprises a bypass valve that selectively allows the cooling fluid to bypass the deioniser.

12. A combination of a cooling system according to claim 1 and an item of industrial equipment, wherein the two-phase heat exchanger of the cooling system is in two-phase heat transfer with the item of industrial equipment for cooling the same.

13. A method of cooling an item of industrial equipment by circulating a cooling fluid around a primary circuit where the cooling fluid is condensed by a primary condenser and in two-phase heat transfer with the item of industrial equipment using a two-phase heat exchanger, and where a proportion of the cooling fluid at an outlet of the two-phase heat exchanger is moved through a secondary circuit, fluidly connected to the primary circuit in parallel with the two-phase heat exchanger, and where the cooling fluid in the secondary circuit is condensed, separated into liquid and gaseous components, and where the pressure of the liquid component of the cooling fluid is reduced to a negative pressure before being returned to the primary circuit so as to reduce the boiling point of the cooling fluid at an inlet of the two-phase heat exchanger.

14. The method according to claim 13, wherein the cooling fluid is deionised.

15. The method according to claim 13, wherein the cooling fluid is moved through the secondary circuit by a pump and the pressure of the liquid component of the cooling fluid is reduced to the negative pressure by a restrictor, and wherein one or both of the pump and the restrictor are adjusted or controlled to select the negative pressure at an outlet of the restrictor.

* * * * *